United States Patent [19]

Puch et al.

[11] 4,297,040

[45] Oct. 27, 1981

[54] METHOD AND APPARATUS FOR POSITIONING A TYPE DISC IN A BALANCED FORCE SYSTEM

[75] Inventors: Diethelm Puch; Norbert F. Will, both of Nuremberg, Fed. Rep. of Germany

[73] Assignee: Triumph-Werke Nurnberg A.G., Nuremberg, Fed. Rep. of Germany

[21] Appl. No.: 159,117

[22] Filed: Jun. 13, 1980

[51] Int. Cl.[3] ..... B41J 1/30; B41J 23/14; B41J 23/16

[52] U.S. Cl. ..... 400/144.2; 101/93.19

[58] Field of Search ..... 400/144.1–144.3, 400/154.4, 155, 162.3, 162.1; 101/93.19, 93.22, 99

[56] References Cited

U.S. PATENT DOCUMENTS

| | | | |
|---|---|---|---|
| 2,905,302 | 9/1959 | Hickerson | 400/162.1 X |
| 3,309,988 | 3/1967 | Touchman | 101/93.22 |
| 3,419,124 | 12/1968 | Sawaki | 400/162.1 X |
| 3,460,343 | 8/1969 | Touchman | 101/93.22 X |
| 3,505,950 | 4/1970 | Harper | 101/93.22 |
| 3,516,528 | 6/1970 | Davidge et al. | 400/162.1 X |
| 3,654,859 | 4/1972 | Touchman | 101/93.22 |
| 3,707,214 | 12/1972 | Ponzano | 400/144.2 |
| 4,226,546 | 10/1980 | Hoffman | 400/144.2 |

FOREIGN PATENT DOCUMENTS

| | | | |
|---|---|---|---|
| 1947580 | 3/1971 | Fed. Rep. of Germany | 400/162.1 |
| 2331618 | 1/1975 | Fed. Rep. of Germany | 400/162.1 |

*Primary Examiner*—Paul T. Sewell

[57] ABSTRACT

A method and apparatus for positioning a type disc in a balanced force system wherein applied selective forces to effect angular positioning movement from an old to a new position are brought into equilibrium with opposing spring forces. Electronic positioning controls are provided to generate forces for application at different times during a positioning movement whereby positioning movement from one equilibrium position to another is accomplished without damping and without overshoot in the shortest optimum fixed time and with the least expenditure of energy. The electronic positioning controls first apply a force corresponding to a new position and then, midway of the angular positioning distance between the old and the new position, apply a force corresponding to the old position to decellerate positioning movement until natural oscillation about the old position carries the disc to the new position at which time the force corresponding to the new position is again applied to hold the new position.

10 Claims, 5 Drawing Figures

ANGULAR POSITION
$P_N$
$P_1+P_N/2$
$P_1$
11
13
20
12
T/6
T/4
T/3
T/2
3T/4
To 16
22
21
20
22
$P_1$
$P_2$
$P_3$
$P_4$
21
23
24

61
62
63
64
51
53
DIFF AMP
83
92
84
DIFF. AMP
dv/dt
CLIPPER
87
85
88
RECTIFIER
RECTIFIER
86
89
RC SMOOTHER
91
82
+/-
COMPARE
SET
81

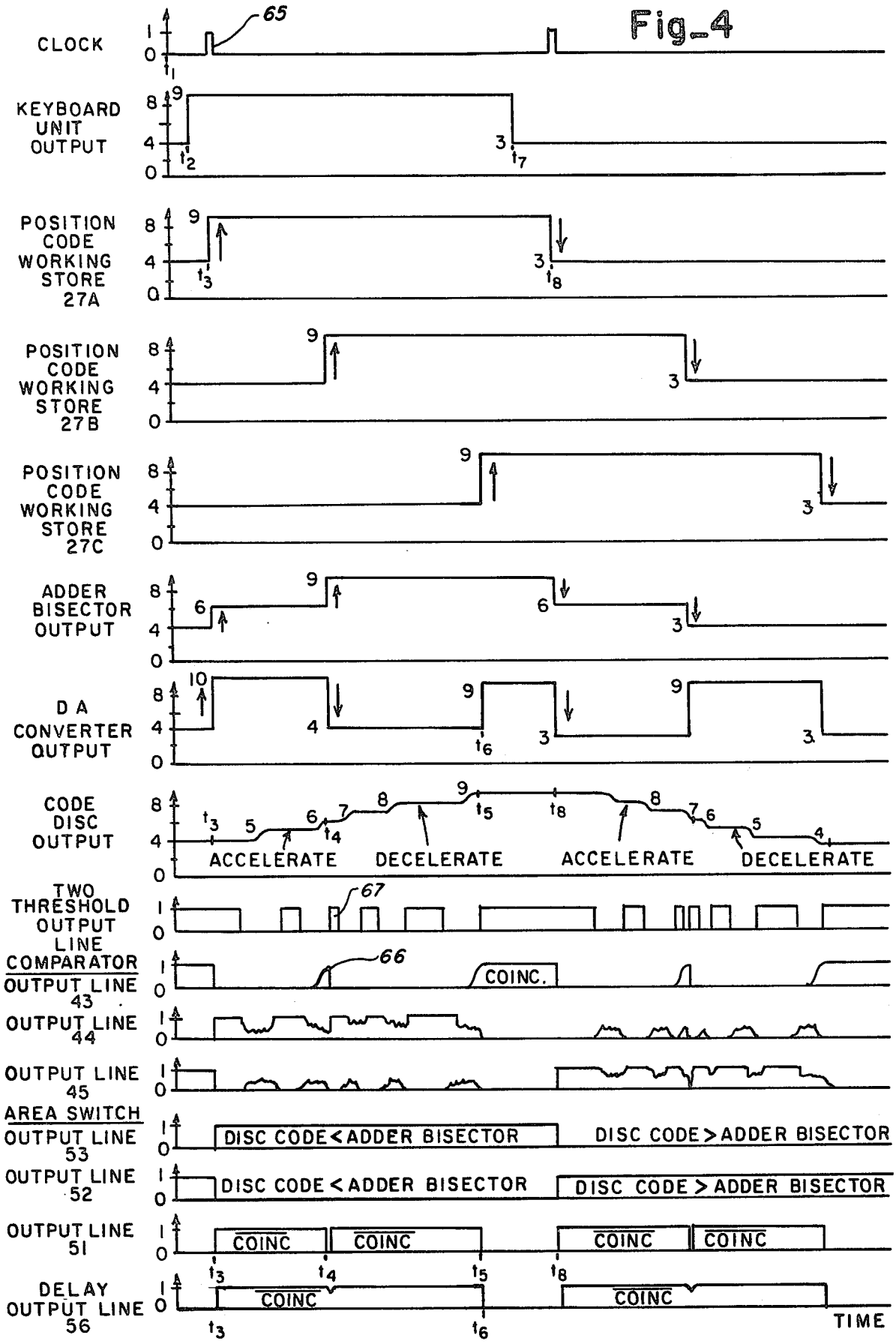
Fig-4
CLOCK
65
KEYBOARD UNIT OUTPUT
POSITION CODE WORKING STORE 27A
POSITION CODE WORKING STORE 27B
POSITION CODE WORKING STORE 27C
ADDER BISECTOR OUTPUT
D A CONVERTER OUTPUT
CODE DISC OUTPUT
ACCELERATE
DECELERATE
ACCELERATE
DECELERATE
TWO THRESHOLD OUTPUT LINE
67
COMPARATOR OUTPUT LINE 43
66
COINC.
OUTPUT LINE 44
OUTPUT LINE 45
AREA SWITCH OUTPUT LINE 53
DISC CODE < ADDER BISECTOR
DISC CODE > ADDER BISECTOR
OUTPUT LINE 52
DISC CODE < ADDER BISECTOR
DISC CODE > ADDER BISECTOR
OUTPUT LINE 51
COINC
DELAY OUTPUT LINE 56
TIME

METHOD AND APPARATUS FOR POSITIONING A TYPE DISC IN A BALANCED FORCE SYSTEM

This invention relates to a method and electronic controls for positioning in the shortest optimum cycle time a type disc in a balanced force system from one position, corresponding to an equilibrium of applied forces and oppositely acting spring forces, to another equilibrium position; more particularly it relates to electronic controls having applied force switching means for applying forces to cause the type disc to accellerate from the old toward the new position and, midway of the angular distance between old and new positions, to decellerate to the new position without overshoot.

A balanced force type disc positioning system wherein at all angular type disc positions an equilibrium exists between applied forces and opposing spring forces is disclosed in copending application Ser. No. 99,541, filed Dec. 3, 1979. In application Ser. No. 99,541, a discrete force corresponding to a new position is applied and the natural oscillation of the system about the new position is damped to achieve a new equilibrium in a given or selected cycle time. As the amplitude of oscillation about the new position is a function of angular distance to be travelled to the new position, not only is significant damping required but the cycle time within which equilibrium is reached is long.

In accordance with the invention positioning from one position to another is accomplished without damping allowing shorter cycle times and requiring less energy. More particularly in accordance with the invention an electronic positioning control is provided to first apply a force corresponding to a new position to accelerate the type disc from an old position toward a new position and, midway of the angular distance between old and new positions, to apply a force corresponding to the old position to decellerate to the new position, and at the new position to again apply a force corresponding to the new position to maintain the type disc at the new position. The electronic positioning controls include circuit means to calculate the mean or average of the new and old positions for comparison with instantaneous type disc positions to effect force switching at proper times whereby movement without damping is accomplished within an established cycle time.

An object of the invention is to provide a method and electronic controls for positioning a balance force positioning system without the necessity for damping.

Another object of the invention is in the provision of electronic control means for accurately positioning a balanced force type disc positioning system to any position in a fixed time period without overshoot.

Still another object of the invention is in the provision of positioning control means which minimizes the expenditure of energy needed to position a balanced force type disc positioning system.

A further object of the invention is in the provision of control means for accurately positioning a type disc which compensates for friction and temperature dependent resistance variations as would affect the applied force.

Other objects and many of the attendant advantages of this invention will be readily appreciated as the same becomes better understood by reference to the following detailed description when considered in connection with the accompanying drawing in which like reference numerals designate like or corresponding parts throughout the figures thereof and wherein:

FIG. 4 is a timing diagram depicting events in the block diagram of FIG. 2.

Figure 1:
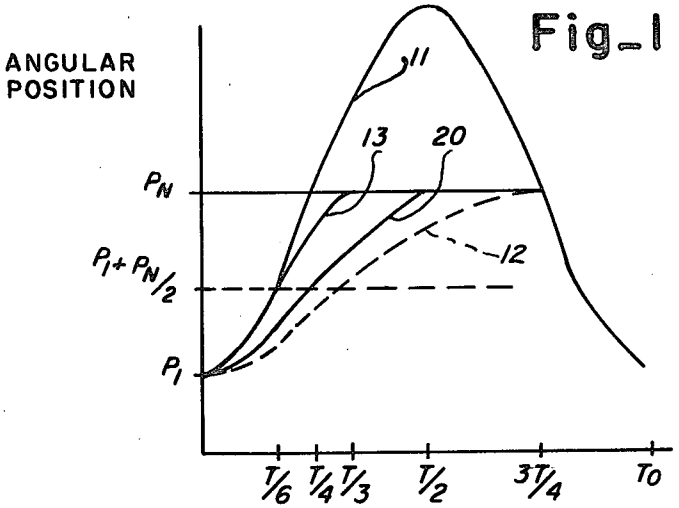
FIG. 1 is a graph showing type disc positioning movement with time illustrating the invention.

Reference is first made to FIG. 1 which depicts curves of angular disc position versus time to expose the concept of the present invention. As disclosed in said copending application, which is incorporated by reference herein, to move a type disc from an angular position $P_1$ to a new position $P_n$, an applied force corresponding to the new position $P_n$ will, in the absence of damping, cause the system to oscillate at its natural frequency about the new position $P_n$ as illustrated by curve 11 in FIG. 1. To bring the system to equilibrium at position $P_n$ within a given fixed time, requires, as disclosed in said copending application, that the natural oscillation be damped to follow for example, curve 12 to reach $P_n$ at a time which is on the order of $\frac{3}{4}$ of the period $T_o$ of natural oscillation.

In accordance with the invention, again with reference to FIG. 1, a force corresponding to position $P_n$ is applied and movement follows the natural oscillation about position $P_n$. However this force corresponding to position $P_n$ is maintained only until the angular position $P_1+P_n/2$ of the disc is reached, at a time, $T_o/6$, and at this time a force corresponding to position $P_1$ is applied so that now movement follows the natural oscillation of the system about position $P_1$, as shown by curve 13, whose maximum amplitude, at which velocity is zero, reaches position $P_n$ at a time corresponding to $\frac{1}{3}$ of the natural oscillation period $T_o$ about desired position $P_n$. At time $T_o/3$ a force corresponding to position $P_n$ is again applied to hold position $P_n$. Thus positioning is effected in a shorter period without overshoot or energy dissipating damping, and with a smaller average expenditure of energy.

Figure 2:
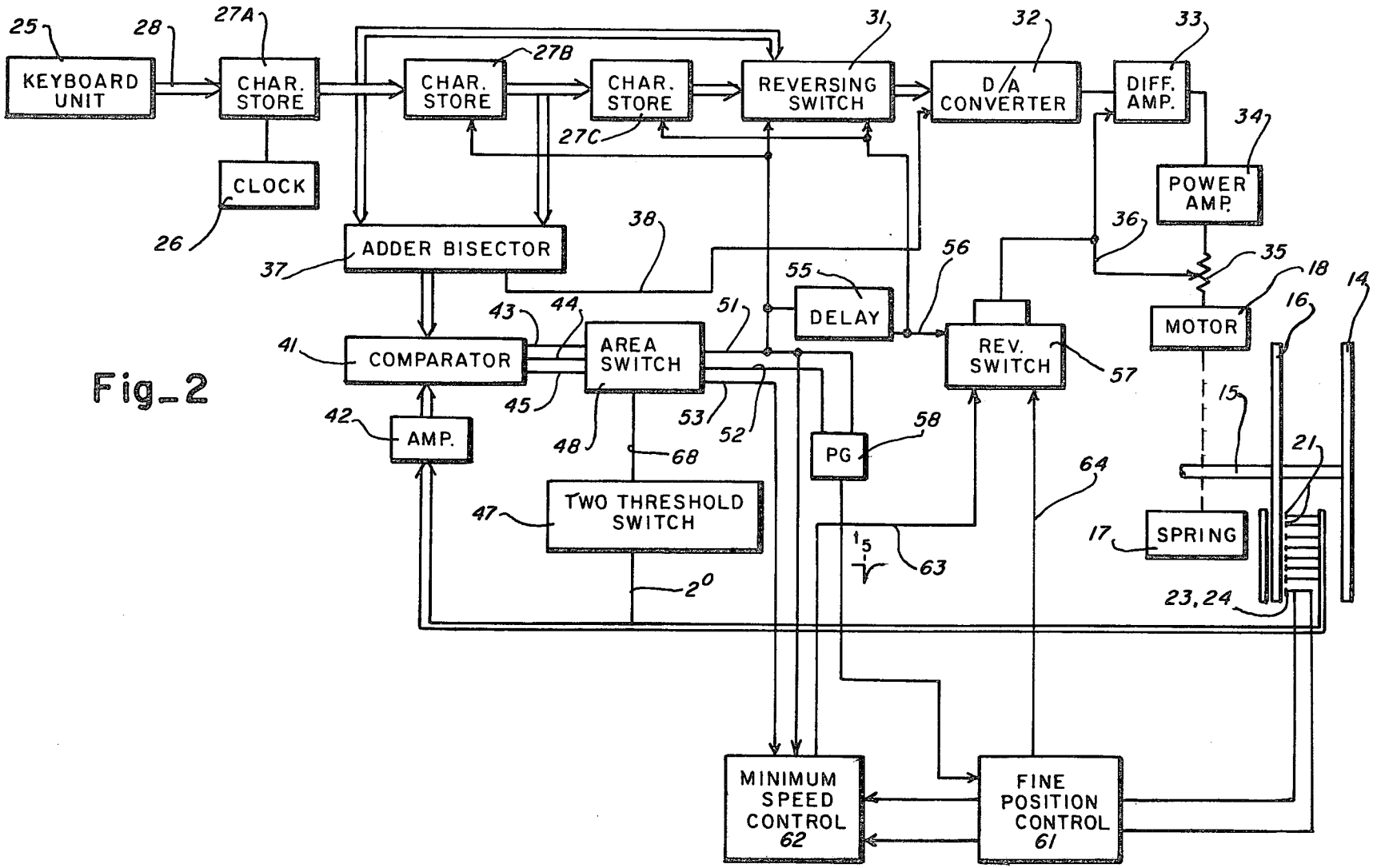
FIG. 2 is a block diagram of of electronic controls for positioning a type disc in accordance with the invention.

The implementation of the invention is shown in FIG. 2 wherein a type disc 14 is shown mounted on a shaft 15 which also mounts a code disc 16. The shaft 15 is urged in one angular direction by a spring 17 acting oppositely to an applied force generated by a motor source 18 in the form of a d.c. motor or a moving coil magnet as described in said copending application Ser. No. 99,541.

Figure 3:
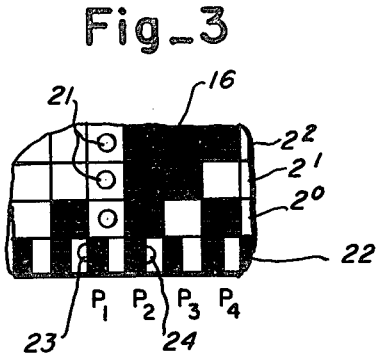
FIG. 3 is a partial plan view of a code disc.

Having reference to FIG. 3 which shows a portion of the code disc 16, circumferential bit tracks $2^{0-26}$ are provided which together, at each angular position $P_1$, $P_2$, $P_n$, etc. define a code for the character on the type disc 14 at the corresponding angular position. The position codes are read out, e.g., by a fixed radial array of light transducers 21. The code disc 16 also includes a circumferential track 22 shown as the radially outermost track, having each angular position divided into dark and light areas. Associated with track 22 are two light transducers with one 23 displaced from or leading the code transducers 21 by half an angular position and the other 24 displaced from or lagging the code transducers 21 by one angular position. The 180° out of phase sine wave signals generated by transducers 23 and 24 are employed to provide information as to the angular velocity of the type disc shaft 15 as will hereinafter appear.

Referring again to FIG. 2 there is shown a keyboard unit 25 wherein the keys thereof are encoded into multi-bit position codes. The keyboard unit 25 preferably also includes a buffer for holding serially generated position codes for release therefrom one at a time at periodic intervals. To this end a clock pulse generator 26 is employed to clock a first single character working storage unit 27A to accept position codes presented on lines 28 from the keyboard unit 25. The entry of a new position code into working storage unit 27A effects erasure of a previous position code therein. The output of the first working store 27A is connected to a second similar working storage unit 27B and to a reversing switch 31. A third similar working storage unit 27C has its input connected to the output of the second working store 27B and has its output connected to a second input of the reversing switch 31. The reversing switch 31 is conditioned, as will hereinafter appear, to pass to its output either the position code in working store 27A or 27C. The output of the reversing switch 31 is connected to a digital to analogue converter 32 which generates an output voltage proportional to the position code, and conveys the voltage signal to one input of a differential amplifier 33. The output of the differential amplifier 33 is amplified in a power amplifier 34, such as disclosed in said copending application and applied to the motor 18. Also as described in said copending application a resistor 35 in series with the motor 18 is tapped to provide a current regulating feedback voltage over line 36 to the other input of the differential amplifier 33 to correct for temperature dependent resistance variations.

As shown in FIG. 2 the output of the first and second working stores 27A and 27B are connected to an adder-bisector circuit 37 whose output is a position code representing a number which is the mean of the position codes in working stores 27A and 27B. Where the mean is not an integer, the remainder is developed as a code representing one angular position which is conveyed over line 38 to the digital to analogue converter 32 for addition with the position code at the output of reversing switch 31.

The output of the adder bisector 37 is conveyed to a comparator 41 for comparison with the code generated at the code disc 16 by the transducers 21 following amplification of the position code signals in an amplifier 42. The comparator has three output lines 43, 44 and 45. The output line 43 carries a signal representing coincidence or not coincidence. The output lines 44 and 45 carry signals indicating respectively that, prior to coincidence the position code read from the code disc 16 is a number smaller than and larger than the number represented by the position code at the output of the adder bisector 37.

As shown in FIG. 2 sine wave signals from track $2^0$ are applied to a two threshold switch 47 which switches when the amplitude of the sine wave signals exceeds a negative and a positive threshold. Thus, at the output of the two threshold switch 47, square wave signals are generated corresponding to the times as shown in FIG. 4 over which an angular position is centered relative to the transducers 21.

The output signals of the two threshold switch 47, whose frequency varies with the angular velocity of the code disc 16, are applied to a range or area identification switch 48 to effect switching therethrough of the signals on the output lines 43, 44 and 45 of the comparator 41 to output lines 51, 52 and 53 of the range identification switch 48.

As shown the output line 51 carrying the coincidence or non coincidence signal shown as high and low respectively in FIG. 4 is connected to reversing switch 31 and to working store 27B so that when coincidence is detected by the comparator 41, working store 27B is clocked to accept the new position code in working store 27A, and reversing switch 31 switches to thereby switch through to the digital to analogue converter 32 the old position code in working store 27C.

Output line 51 is also connected to a delay circuit 55 whose output line 56 is connected to working store 27C and to reversing switch 31 thereby in response to a change from non coincidence to coincidence signal condition to clock working store 27C to accept the position code in working store 27B without affecting reversing switch 31. The output line 56 from the delay circuit 55 is also connected to the switching terminal of a second reversing switch 57. As will hereinafter appear and with reference to FIG. 4 reversing switch 57 is, in response to changes from coincidence to non coincidence signal condition and from non coincidence to coincidence signal condition, conditioned respectively to pass minimum speed or fine position control signals to the second input of the differential amplifier 33.

Output line 51 of the range identification switch 48 is also directly connected together with output line 52 thereof to a decellerating pulse generator 58 which delivers decellerating pulses to a fine positioning control circuit, generally designated by reference numeral 61.

Output line 51 together with output line 53 of the range identification switch 48 is also connected to the minimum speed control circuit generally designated by reference numeral 62.

The outputs of the fine positioning and the minimum speed control circuits 61 and 62 to be described hereinafter are connected to the second reversing switch 57 over lines 63 and 64 respectively.

Referring particularly now to FIG. 4 the system is shown in equilibrium at a time $t_1$ following a positioning movement to and with the type disc 14 at the #4 position. In this equilibrium condition all three of the working stores 27A, 27B and 27C contain the #4 position code, corresponding to position $P_1$ in FIG. 1; the digital to analogue converter 32 is issuing a voltage corresponding to the #4 position code in working store 27A thereby to maintain the equilibrium position, and the output lines 43, 44 and 45 of comparator 41 and the output lines 51, 52 and 53 of the range identification switch 48 carry signals as shown indicating coincident conditions at position #4.

At a time $t_2$ the keyboard unit makes available a #9 position code and at time $t_3$, the #9 position code is clocked into working store 27A by a clock pulse 65. The #9 position code in working store 27A is conveyed through reversing switch 31, which is conditioned at time $t_1$ to pass the position code signals from working store 27A, to the digital to analogue converter 32 to develop a voltage to initiate positioning movement to the #9 type disc position.

At time $t_3$, as working stores 27A and 27B, whose outputs are connected to the adder bisector 37, now contain the new #9 position code, designated $P_n$ in FIG. 1 and the old #4 position code, designated $P_1$ in FIG. 1, the adder bisector 37 develops a #6 position code corresponding to $P_1+P_n/2$ for application to the comparator 41. Where $P_1+P_n/2$ results in a fraction as hereinbefore noted, only the integral number issues to the comparator 41 and a #1 position code corresponding to the fraction is conveyed over line 38 to the digital to analogue converter 32 for addition to the #9 position code with the result that a voltage corresponding to a #10 position code is generated. Thus at time $t_3$ the outputs of the comparator 41 and the range switch 48 change from coincidence to non coincident condition as shown.

The output of the digital to analogue converter 31 corresponding to position code #10 will cause the motive source 18 to accellerate the type disc 14 towards position #9 with the result that the code disc transducers 21 will generate numerically increasing position code signals and the two threshold switch 47 will generate gating signals. When the type disc 14 reaches position $P_1+P_n/2$ i.e. the #6 position, shown occurring at time $t_4$, the output line 43 of the comparator 41 issues a coincidence signal 66 which is passed through to output line 51 of the range identification switch 48 by the signal 67 at the output 68 of the two threshold switch 47.

Thus at time $t_4$, the midpoint coincidence signal on line 51 is effective to reverse switch 31 which now passes the #4 position code in working store 27C to the digital to analogue converter 32 which beginning at time $t_4$ now applies a voltage proportional to the #4 position code to the motor source 18 effecting decellerating movement towards position #9. As shown the coincidence signal at time $t_4$ is also effective to clock working store 27B to accept the #9 position code from working store 27A. Accordingly at time $t_4$ corresponding to 1/6 the natural oscillation period $T_o$ of the system about position #4, the decelleration process begins and non coincidence conditions again prevail.

As working stores 27A and 27B at time $t_4$ now contain the #9 position code, the output of the adder bisector 37 is now the #9 position code and there is no fractional remainder on line 38. During the deceleration process the #9 position code at the output of the adder bisector 37 is compared with the numerically increasing position codes read from the code disc 16. Upon again reading coincidence at time $t_5$ corresponding to $\frac{1}{3}$ the natural oscillation period $T_o$ about the #4 position or $P_1$ as shown in FIG. 1, the coincidence signal on line 51 at $t_5$ has no effect on reversing switch 31 as it was previously operated by the coincidence signal on line 51 at time $t_4$, though it again clocks working store 27B. Working store 27B however already contains the #9 position code and is therefore not changed. The change to coincident signal condition on line 51 is, after a slight delay in circuit 55, effective on line 56 to reverse the reversing switch 31 to thereby allow at time $t_6$ the #9 position code in working store 27A to again pass to the digital to analogue converter 32 to generate a corresponding voltage to maintain the system in equilibrium position #9. Also at time $t_6$ the signal on line 56 clocks memory 27C to accept the #9 position code in working store 27B. Thus at time $t_6$ a new equilibrium position corresponding to $P_n$ FIG. 1 is reached and maintained.

FIG. 4 also shows a #3 position code appearing at the output of the keyboard unit at time $t_7$ which is clocked out at time $t_8$. The process is the same except that rotational movement from the old #9 to the new #3 position is reversed.

In that tolerance in the mechanical system could present frictional forces which could resist initial accelerating movement between closely spaced positions or resist final decellerating movement, the minimum speed control circuit 62 is provided.

Figure 5:
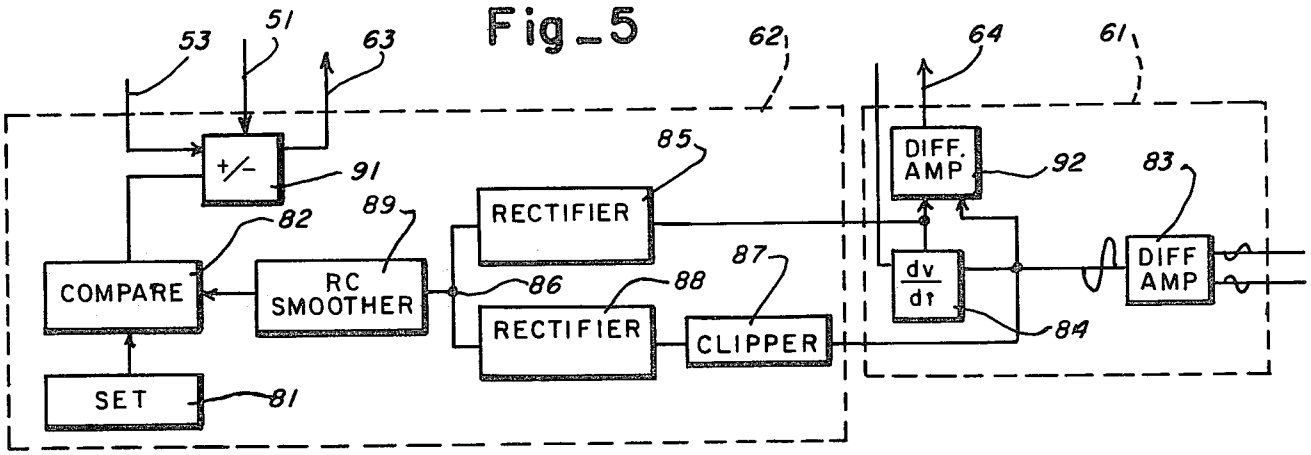
FIG. 5 is a block diagram showing units of FIG. 2 in greater detail.

With reference to FIG. 5 the minimum necessary speed to overcome friction is predetermined and a corresponding voltage is set in a minimum speed setting device 81. This voltage is connected to one input a comparator 82. The other input to the comparator 82 has applied thereto a derived voltage signal representing the actual speed of the type disc shaft 15. The actual speed is developed from the transducers 23 and 24 which develop 180° out of phase sine wave signals. These are fed to a differential amplifier 83.

The sine wave output of the differential amplifier 83 is connected to one input of a differentiating circuit 84. Another input to the differentiating circuit has applied thereto either positive or negative going pulses from the decelerating pulse generator 58. These pulses are generated at time $t_5$ when line 51 changes from non coincident to coincident signal condition, with the polarity, determined by the signal condition on line 52, being negative (FIG. 2) and positive respectively when the signal on line 52 represents that the code disc position at time $t_3$ was less than or more than the position code at the output of the adder bisector 37. The output of the differentiating circuit 84 is a signal 90° out of phase with the output signal from the differential amplifier 83 and represents the disc velocity which is passed to a full wave rectifier 85 to a summing terminal 86. In order to provide a generated velocity signal of constant magnitude, the sine wave output of the differential amplifier 83 is also passed through a base clipper circuit 87 and another full wave rectifier 88 whose output is also connected to the summing terminal 86. The combination of the signals at the summing terminal 86 produces a voltage with only slight ripple for application to an RC smoothing circuit 89 whose output is a velocity signal of varying magnitude for comparison with the minimum speed voltage set by device 81.

The comparator 82 will generate an output signal whenever the actual speed is less than the minimum speed necessary to overcome friction for application, via the reversing switch 57, to the second input of the differential amplifier 33. Switch 57 is enabled by a not coincident signal condition on line 56 at delayed time $t_3$ following the start of the accelleration phase and is disabled by the delayed coincident signal condition generated on line 56 at a time $t_6$ during the final decelerating stage in advance of equilibrium.

The minimum speed signal generated at the output of the comparator 82 must be of the proper polarity to initiate rotational movement in the proper direction. To this end, comparator output signals on lines 44 and 45 indicate the proper direction of rotation for movement to a new position according to whether the code position read from the code disc 16 at the old position is greater or less than the position code at the output of the adder bisector 37 when a new position code is entered into working store 27A. The signals on lines 44 and 45 are developed in the range identification switch to produce on output line 53 a signal whose polarity is determined according to whether the position code read from code disc 16 is numerically greater or smaller than the mean of the new and old position codes. The polarity of the signals on line 52 together with a non coincidence signal condition on line 51 controls a direction switch 91 in the minimum speed control 62 to which the output of the comparator 82 is connected. Thus the output of the direction switch on line 63 will be a minimum speed voltage of the proper polarity for application to the differential amplifier 33 during initial accelleration and final decelleration stages when necessary.

FIG. 5 also shows the fine position control circuit 61 which includes differential amplifier 83, differentiator 84 and a second differential amplifier 92. The position signal at the output of the differential amplifier 83 and the velocity signal at the output of differentiator 87 are connected to the input of the differential amplifier 92 whose output is connected over line 64 to reversing switch 57 enabled at time $t_6$ to pass fine positioning decellerating signals to the differential amplifier 33 to bring to and maintain the type disc 14 at the new equilibrium position.

An alternative concept within the scope of the invention is illustrated in FIG. 1, wherein is shown a curve 20 defined by application of a voltage proportional to the mean of the old and new positions $P_1+P_n/2$ to the digital to analogue converter 32 on entry of a new position $P_n$ so that movement is in accordance with natural oscillation about position $P_1+P_n/2$ with the maximum amplitude of oscillation occurring at the new position $P_n$ at $\frac{1}{2}$ the period $T_o$ of natural oscillation, at which time a voltage corresponding to the new position $P_n$ would be switched in to hold the system in equilibrium.

The invention claimed is:

1. The method for positioning a type disc in a fixed cycle balanced force system, wherein applied forces to effect angular positioning movement from an old to a new position are brought into equilibrium with opposing spring forces without damping or overshoot, comprising the steps of applying positioning forces to effect angular positioning movement from an old to a new position according to the natural oscillation of the system about a selected reference position, whereby the new position is reached at the maximum amplitude of the oscillation of the system about the reference position when angular velocity is zero, and applying a force corresponding to the new position when the new position is reached to maintain the system at the new position.

2. The method recited in claim 1, said step of applying positioning forces comprising the steps of first applying a force corresponding to a new position to effect angular positioning movement of the type disc toward the new position according to the natural oscillation of the system about the new position, and applying, midway of the movement between the old and new positions, a force corresponding to the old position to effect angular positioning movement toward the new position according to the natural oscillation of the system about the old position.

3. The method for positioning a type disc in a fixed cycle balanced force system, wherein applied forces to effect angular positioning movement from an old to a new position are brought into equilibrium with opposing spring forces without damping or overshoot comprising the steps of storing a signal representing the old position, generating a new position signal, applying a force corresponding to a new position signal to effect angular positioning movement of the type disc according to the natural oscillation of the system about the new position, reading instantaneous type disc positions, computing the mean of the old and new positions, comparing the mean position with said instantaneous type disc positions to determine the movement midway of the old new disc positions, applying, midway of the movement between the old and new positions, a force corresponding the old position to effect angular positioning movement according to the natural oscillation of the system about the old position, and reapplying the force corresponding to the new position when the maximum amplitude of oscillation about the old position corresponding to the new position is reached to maintain the new position.

4. Apparatus for positioning a type disc in a fixed cycle balanced force system, wherein applied forces to effect angular positioning movement from an old to a new position are brought into equilibrium with opposing spring forces without damping or overshoot comprising means for applying positioning forces to effect angular positioning movement from an old to a new disc position according to the natural oscillation of the system about a selected reference position whereby the new position is reached at the maximum amplitude of the oscillation of the system about the reference position when angular velocity is zero, and means for applying a force corresponding to the new position when the new position is reached to maintain the system at the new position.

5. The apparatus recited in claim 4, said means for applying positioning forces comprising first means for applying a force corresponding to a new position to effect angular positioning movement of the type disc toward the new position according to the natural oscillation of the system about the new position, and end means for applying, midway of the movement between the old and new positions, a force corresponding to the old position to effect angular positioning movement toward the new position according to the natural oscillation of the system about the old position.

6. Apparatus for positioning a type disc in a fixed cycle balanced force system wherein applied forces to effect angular positioning movement from an old to a new position are brought into equilibrium with opposing spring forces without damping or overshoot comprising means for storing old position signals and new position signals, means for applying a force corresponding to a new position signal to effect angular positioning movement of the type disc according to the natural oscillation of the system about the new position, means for determining the position of the type disc, midway of the movement between the old and new positions and for applying at the midway position a force corresponding the old position signal to effect angular positioning movement according to the natural oscillation of the system about the old position, and means for reapplying the force corresponding to the new position signal when the maximum amplitude of oscillation about the old position corresponding to the new position is reached to maintain the new position.

7. A typewriter having a rotatably supported shaft mounting a type disc, said shaft being adapted to be selectively positioned from one angular position to another by bringing into equilibrium applied positioning forces acting on said shaft in opposition to spring forces acting on said shaft, a code disc mounted on said shaft, transducers mounted to read and generate code signals corresponding to the angular position of said shaft relative to a reference position, first, second and third position code storage means each storing the code representing the last position to which said shaft was rotated to present a character on said type disc at a printing position, applied force generating means responsive to stored position codes, switch means normally conditioned to pass the position code stored in said first storage means to said applied force generating means for maintaining equilibrium at the last position selected, keyboard means for generating a position code representing a new shaft position, means for entering the position code representing the new shaft position into said first storage means, said normally conditioned switch means passing said new position code in said first storage means to said force applying means whereby rotation of said shaft accellerates toward said new position, means for computing the mean of the position codes in said first and second storage means, means for comparing the output of said computing means with the position codes being read by said transducers, means responsive to coincidence of said compared position code signals for reversing said switch means to effect passage of the position code in said third storage means to said force applying means, whereby said shaft rotation decellerates toward the new position, and for transferring the position code in said first storage means to said second storage means whereby both will again contain the position code corresponding to the new position, and means responsive to second coincidence of compared position codes, indicating angular positioning movement to the new position is accomplished, for again passing the new position code in said first storage means to said force applying means and for transferring the position code in said second storage means to said third storage means.

8. A typewriter as recited in claim 7, said applied force generating means comprising a digital to analogue converter for generating voltages proportional to position codes applied thereto, amplifier means connected to the output of said digital to analogue converter, and motor means responsive to voltages at the output of said amplifier means for rotating said type disc shaft.

9. A typewriter as recited in claim 8, said amplifier means including a differential amplifier, and means for feeding back to said differential amplifier a voltage to correct for temperature dependent resistance changes.

10. A typewriter as recited in claim 8, including means for generating a voltage corresponding to the actual speed of positioning movement, means establishing a voltage representing a minimum speed, means for comparing said actual speed and minimum speed voltages, and means for providing a compensating voltage to said differential amplifier whenever actual speed is less than minimum speed.

* * * * *